US009243350B2

(12) United States Patent
Kikuchi et al.

(10) Patent No.: US 9,243,350 B2
(45) Date of Patent: Jan. 26, 2016

(54) META-TYPE WHOLLY AROMATIC POLYAMIDE FIBER

(75) Inventors: Satoshi Kikuchi, Iwakuni (JP); Kotaro Takiue, Iwakuni (JP)

(73) Assignee: Teijin Limited, Osaka (JP)

( * ) Notice: Subject to any disclaimer, the term of this patent is extended or adjusted under 35 U.S.C. 154(b) by 99 days.

(21) Appl. No.: 13/639,033

(22) PCT Filed: Apr. 8, 2011

(86) PCT No.: PCT/JP2011/058909

§ 371 (c)(1), (2), (4) Date: Oct. 2, 2012

(87) PCT Pub. No.: WO2011/129279

PCT Pub. Date: Oct. 20, 2011

(65) Prior Publication Data

US 2013/0023610 A1 Jan. 24, 2013

(30) Foreign Application Priority Data

Apr. 14, 2010 (JP) ..... 2010-093289
Apr. 6, 2011 (JP) ..... 2011-084556

(51) Int. Cl.

| | |
|---|---|
| ***C08L 77/10*** | (2006.01) |
| ***C08K 5/07*** | (2006.01) |
| ***C08K 5/3475*** | (2006.01) |
| ***C08K 5/09*** | (2006.01) |
| ***D01F 6/60*** | (2006.01) |
| ***D01F 1/10*** | (2006.01) |
| *D06P 3/24* | (2006.01) |

(52) U.S. Cl.
CPC ..... *D01F 6/605* (2013.01); *D01F 1/106* (2013.01); *D06P 3/242* (2013.01)

(58) Field of Classification Search
CPC ..... C08K 5/07; C08K 5/09; C08L 77/10; D01F 1/106; D01F 6/605; D06P 3/242
USPC ..... 524/91, 291, 359, 606
See application file for complete search history.

(56) References Cited

U.S. PATENT DOCUMENTS

| | | | | |
|---|---|---|---|---|
| 3,779,705 | A | 12/1973 | Kitamura et al. | |
| 3,888,821 | A | 6/1975 | Milford, Jr. | |
| 4,710,200 | A | 12/1987 | Cates et al. | |
| 5,852,087 | A | 12/1998 | Ohba et al. | |
| 2009/0312466 | A1* | 12/2009 | Hase | 524/100 |

FOREIGN PATENT DOCUMENTS

| | | | |
|---|---|---|---|
| JP | 47-10863 | B | 3/1972 |
| JP | 49-75824 | A | 7/1974 |
| JP | 50-59522 | A | 5/1975 |
| JP | 53-126312 | A | 11/1978 |
| JP | 53-126313 | A | 11/1978 |
| JP | 05-214673 | A | 8/1993 |
| JP | 06-330409 | A | 11/1994 |
| JP | 2003-239136 | A | 8/2003 |
| WO | 2010/035834 | A1 | 4/2010 |

OTHER PUBLICATIONS

European Search Report issued on Sep. 6, 2013 in European Patent Application No. 11768800.2.
European Office Action issued on Oct. 2, 2013 in European Patent Application No. 11768800.2.
Reinert et al., "Stabilisation of textile fibres against ageing", Rev. Prog. Coloration, 1997, vol. 27, pp. 32-41.
Mexican Office Action issued Aug. 25, 2014, for Application No. MX/a/2012/010832, 7 pages.

* cited by examiner

*Primary Examiner* — Kriellion Sanders
(74) *Attorney, Agent, or Firm* — Sughrue Mion, PLLC

(57) ABSTRACT

By forming a meta-type wholly aromatic polyamide fiber using a highly hydrophobic UV absorber and having specific physical properties, a meta-type wholly aromatic polyamide fiber having light resistance, which can be dyed in various hues by carrier dyeing and in which the shedding of a light stabilizer during dyeing can be suppressed, is provided. That is, the meta-type wholly aromatic polyamide fiber contains a UV absorber with a water solubility of less than 0.04 mg/L and has a degree of dye exhaustion of 90% or more in the form of a dyed fiber and a light resistance retention of 80% or more after carrier dyeing.

8 Claims, No Drawings

META-TYPE WHOLLY AROMATIC POLYAMIDE FIBER

CROSS REFERENCE TO RELATED APPLICATIONS

This application is a National Stage of International Application No. PCT/JP2011/058909, filed on Apr. 8, 2011, the contents of which are incorporated herein by reference in their entirety.

TECHNICAL FIELD

The present invention relates to a meta-type wholly aromatic polyamide fiber. More specifically, the invention relates to a meta-type wholly aromatic polyamide fiber having light resistance, in which the shedding of a light stabilizer during carrier dyeing can be suppressed.

BACKGROUND ART

Wholly aromatic polyamide (hereinafter sometimes simply referred to as aramid) fibers include meta-aramid fibers such as Conex® and Nomex® and para-aramid fibers such as Technora®, Kevlar®, and Twaron®.

These aramid fibers have a rigid molecular structure and high crystallinity. Accordingly, as compared with widely used, conventional aliphatic polyamide fibers such as Nylon 6 and Nylon 66, aramid fibers have excellent safety properties in terms of thermal properties such as heat resistance and fire resistance (flame retardancy), chemical resistance, high radiation resistance, electrical characteristics, etc. Therefore, they have been widely used for garment applications such as protective suits that require fire resistance (flame retardancy) and heat resistance, industrial material applications such as bag filters, and interior design applications such as curtains.

Here, methods for obtaining a colored fiber for garment applications and the like generally include a method that utilizes dyeing and a method that utilizes spin-dyeing with dyes and pigments. Further, as a method for coloring a wholly aromatic polyamide fiber, for example, a method that dyes a fiber using a basic dye and a dyeing assistant (carrier) such as benzyl alcohol or acetophenone is generally known.

However, there is a problem in that when wholly aromatic polyamide fibers are dyed with basic dyes such as those used for dyeing aliphatic polyamide fibers, the resulting colored fibers have extremely low light resistance and thus undergo significant fading due to light.

Thus, for the purpose of improving the light resistance of a colored wholly aromatic polyamide fiber, JP-A-49-075824 (Patent Document 1) proposes a method in which an aromatic polyamide solution is dry- or wet-spun, then the obtained fiber is washed, and, before drying, the fiber is impregnated with an aqueous dispersion of a UV-shielding substance. However, this method has a problem in that during carrier dyeing, the carrier is likely to cause the shedding of the UV-shielding substance.

In addition, as a light-resistant wholly aromatic polyamide fiber that can be dyed without a carrier, JP-A-2003-239136 (Patent Document 2) discloses a meta-type wholly aromatic polyamide fiber containing an alkylbenzene sulfonic acid onium salt as a dyeing assistant and a hindered amine light stabilizer. This fiber can be dyed without a carrier, and thus the shedding of a light stabilizer is unlikely to occur during dyeing. However, the addition of the onium salt increases the cost of fiber production. In addition, it decreases the flame retardancy of the resulting fiber, requiring the further addition of a flame retardant or the like.

Further, a light-resistant colored meta-type wholly aromatic polyamide fiber containing a specific pigment that does not fade due to light has been proposed (JP-A-50-59522, Patent Document 3). However, in such a method, the pigment is added during the fiber production process. Accordingly, there are problems in that the loss of production is high, it is difficult to handle small-lot production, it is difficult to obtain fibers in various hues as required, etc.

PRIOR ART DOCUMENTS

Patent Documents

Patent Document 1: JP-A-49-075824
Patent Document 2: JP-A-2003-239136
Patent Document 3: JP-A-50-59522

SUMMARY OF THE INVENTION

Problems that the Invention is to Solve

The invention was accomplished against the above background. An object of the invention is to provide a meta-type wholly aromatic polyamide fiber having light resistance, which can be dyed in various hues by carrier dyeing and in which the shedding of a light stabilizer during dyeing can be suppressed.

Means for Solving the Problems

The present inventors conducted extensive research to solve the above problems. As a result, they found that the above problems can be solved by forming a meta-type wholly aromatic polyamide fiber which uses a highly hydrophobic UV absorber and has specific physical properties. They thus accomplished the invention.

That is, the invention is a wholly aromatic polyamide fiber containing a UV absorber with a water solubility of less than 0.04 mg/L and having a degree of dye exhaustion of 90% or more in the form of a dyed fiber and a light resistance retention of 80% or more after carrier dyeing.

Advantage of the Invention

The meta-type wholly aromatic polyamide fiber of the invention serves as a fiber having light resistance, which can be dyed in various hues by carrier dyeing and in which the shedding of a light stabilizer during dyeing can be suppressed.

Further, even in the case where the meta-type wholly aromatic polyamide fiber of the invention is subjected to prolonged light irradiation such as prolonged exposure to sunlight, deterioration can be suppressed, whereby its strength can be retained.

Accordingly, the industrial value is extremely high in the fields where dye affinity and light resistance are required. The invention can be suitably used in the fields of bedding, garments, interior design, and the like where aesthetics and visibility are of importance, for example.

MODE FOR CARRYING OUT THE INVENTION

Meta-Type Wholly Aromatic Polyamide Fiber

The meta-type wholly aromatic polyamide fiber of the invention has the following specific physical properties. The physical properties, configuration, production method, and the like of the meta-type wholly aromatic polyamide fiber of the invention will be described hereinafter.

[Physical Properties of Meta-Type Wholly Aromatic Polyamide Fiber]

{Residual Solvent Content}

A meta-type wholly aromatic polyamide fiber is usually produced from a spinning dope obtained by dissolving a polymer in an amide solvent. Therefore, the solvent inevitably remains in the fiber. However, in the meta-type wholly aromatic polyamide fiber of the invention, it is preferable that the amount of residual solvent in the fiber is 0.1 mass % or less based on the mass of the fiber. The amount is preferably 0.1 mass % or less, and more preferably 0.08 mass % or less.

In the case where the amount of residual solvent in the fiber is more than 0.1 mass % based on the mass of the fiber, the residual solvent volatilizes during processing or use in a high-temperature atmosphere at more than 200° C., resulting in poor environmental safety. In addition, the molecular structure is broken, resulting in significantly decreased strength. Therefore, this is undesirable.

In the invention, in order to provide a fiber before dyeing (raw fiber) with a residual solvent content of 0.1 mass % or less, in the fiber production process, coagulation bath components or conditions are adjusted to give a coagulated form having no skin core, and also plastic stretching is performed to a specific ratio.

Incidentally, "residual solvent content of a fiber before dyeing (raw fiber)" in the invention is a value obtained by the following method.

(Method for Measuring Residual Solvent Content)

About 8.0 g of a fiber before dyeing (raw fiber) is collected, dried at 105° C. for 120 minutes, and then allowed to cool in a desiccator, and the fiber mass (M1) is measured. Subsequently, the fiber is subjected to reflux extraction in methanol for 1.5 hours using a Soxhlet extractor to extract the amide solvent contained in the fiber. After extraction, the fiber is removed, vacuum-dried at 150° C. for 60 minutes, and then allowed to cool in a desiccator, and the fiber mass (M2) is measured. Using the obtained M1 and M2, the amount of residual solvent in the fiber (amide solvent mass) N (%) is calculated by the following equation.

$$N(\%)=[(M1-M2)/M1]\times 100 \quad \text{[Equation 1]}$$

{Breaking Strength of Fiber before Dyeing (Raw Fiber)}

It is preferable that the meta-type wholly aromatic polyamide fiber of the invention before dyeing (raw fiber) has a breaking strength of 2.5 cN/dtex or more. The breaking strength is still more preferably 2.7 cN/dtex or more, and particularly preferably 3.0 cN/dtex or more. In the case where the breaking strength is less than 2.5 cN/dtex, the fiber breaks during a post-processing step such as spinning, resulting in decreased process performance; therefore, this is undesirable.

In the invention, the breaking strength of the meta-type wholly aromatic polyamide fiber before dyeing (raw fiber) can be controlled by the draw ratio in the plastic-stretching-bath stretching step and the heat treatment temperature in the dry-heat treatment step in the production method described below. In order to achieve a breaking strength of 2.5 cN/dtex or more, it is necessary that the draw ratio is 3.5 to 5.0, and also that the dry-heat treatment temperature is within a range of 260 to 330° C.

Incidentally, "breaking strength" in the invention is a value obtained by measurement in accordance with JIS L1015 using a tensile tester (manufactured by Instron, Model 5565) under the following conditions.

(Measurement Conditions)

Grip distance: 20 mm

Initial load: 0.044 cN (1/20 g)/dtex

Tensile rate: 20 mm/min

{Elongation at Break of Fiber before Dyeing (Raw Fiber)}

It is preferable that the meta-type wholly aromatic polyamide fiber of the invention before dyeing (raw fiber) has an elongation at break of 30% or more. The elongation at break is still more preferably 35% or more, and particularly preferably 40% or more. An elongation at break of less than 30% leads to decreased passing properties in a post-processing step such as spinning, and thus is undesirable.

In the invention, the elongation at break of the meta-type wholly aromatic polyamide fiber before dyeing (raw fiber) can be controlled by the coagulation bath conditions in the coagulation step in the production method described below. In order to achieve an elongation at break of 30% or more, it is necessary that the coagulation liquid is an aqueous solution of an amide solvent such as N-methyl-2-pyrrolidone (NMP) with a concentration of 45 to 60 mass %, and that the temperature of the bath liquid is 10 to 35° C.

Incidentally, "elongation at break" in the invention is a value obtained by measurement in accordance with JIS L1015 using a tensile tester (manufactured by Instron, Model 5565) under the same conditions as for the measurement of "breaking strength" mentioned above.

{Raman Orientation Index of Fiber before Dyeing (Raw Fiber)}

It is preferable that the meta-type wholly aromatic polyamide fiber of the invention before dyeing (raw fiber) has a Raman orientation index within a range of 1.3 to 2.2. The Raman orientation index is still more preferably within a range of 1.5 to 2.0, and particularly preferably 1.7 to 2.0. In the case where the Raman index is less than 1.3, the strength of a dyed fiber that has undergone a dyeing treatment cannot be sufficiently exhibited; therefore, this is undesirable. Meanwhile, in the case of orientation exceeding 2.2, dye affinity significantly decreases; therefore, this is undesirable. In addition, in the case where the Raman orientation index of the fiber before dyeing (raw fiber) is outside the above range, it may be difficult to provide the meta-type wholly aromatic polyamide fiber of the invention (raw fiber) with a degree of dye exhaustion of 90% or more.

In the invention, the Raman orientation index of the meta-type wholly aromatic polyamide fiber before dyeing (raw fiber) can be controlled by the draw ratio in the plastic-stretching-bath stretching step in the production method described below. Specifically, it is necessary that the draw ratio is 3.5 to 5.0.

Incidentally, "Raman orientation index" in the invention is a value obtained by the following method.

(Calculation Method for Raman Orientation Index)

A fiber before dyeing (raw fiber) is fixed to a sample holder, and measurement is performed using a single laser micro-Raman spectrometer (manufactured by Jobin-Yvon, model: T64000) under the following conditions: a solid-state laser ($\lambda$=785 nm), output: 76 mW. "Raman orientation index" is calculated by the following equation using the peak polarization anisotropy near a Raman shift wavenumber of 1,000 $cm^{-1}$, which is the meta-type wholly aromatic polyamide eigenvalue.

$$\text{Raman orientation index}=[XX\ \text{Raman intensity}/YY\ \text{Raman intensity}] \quad \text{[Equation 2]}$$

(In the equation, XX indicates that the incident polarization plane and the detection polarization plane are parallel to the fiber axis, and YY indicates that the incident polarization plane and the detection polarization plane are perpendicular to the fiber axis.)

{Crystallinity of Fiber before Dyeing (Raw Fiber)}

It is preferable that the meta-type wholly aromatic polyamide fiber of the invention before dyeing (raw fiber) has a crystallinity of 5 to 20%. The crystallinity is still more preferably 5% to 15%, and particularly preferably 5 to 10%. In the case where the crystallinity is more than 20%, dye affinity significantly decreases; therefore, this is undesirable. Meanwhile, in the case where it is less than 5%, such a fiber has high shrinkability and thus is difficult to handle in the dyeing step; therefore, this is undesirable. In addition, in the case where the crystallinity of the fiber before dyeing (raw fiber) is outside the above range, it may be difficult to provide the meta-type wholly aromatic polyamide fiber of the invention (raw fiber) with a degree of dye exhaustion of 90% or more.

In the invention, the crystallinity of the meta-type wholly aromatic polyamide fiber before dyeing (raw fiber) can be controlled by the draw ratio in the plastic-stretching-bath stretching step and the heat treatment temperature in the dry-heat treatment step in the production method described below. Specifically, it is necessary that the draw ratio is 3.5 to 5.0, and also that the dry-heat treatment temperature is within a range of 260 to 330° C.

Incidentally, "crystallinity" in the invention is converted from the profile of a fiber before dyeing (raw fiber) in the form of a bundle about 1 mm in diameter, which is measured using an X-ray diffraction apparatus (trade name: RIGAKU RINT TTR III) under the following conditions.

(Measurement Conditions)

X-ray source: Cu-Kα line

Fiber sample table: 50-rpm rotation

2θ scan: 5 to 50°

Continuous measurement: 0.1°

Width measurement: scan at 1°/min

Specifically, air scattering and incoherent scattering in the measured diffraction profile are corrected by linear approximation to give the total scattering intensity profile. The undried yarn profile of an amorphous meta-type wholly aromatic polyamide fiber is fit to the obtained total scattering intensity by visual estimation, and the difference is taken as the crystal scattering intensity. Crystallinity is calculated by the following equation using the areas of crystal scattering intensity and total scattering intensity (integrated value).

$$\text{Crystallinity (\%)}=[\text{area of crystal scattering intensity}/\text{area of total scattering intensity}]\times 100 \quad \text{[Equation 3]}$$

{Degree of Dye Exhaustion of Dyed Fiber}

The meta-type wholly aromatic polyamide fiber of the invention has a degree of dye exhaustion of 90% or more, preferably 92% or more, in the form of a fiber after dyeing (dyed fiber). In the case where the degree of dye exhaustion of a dyed fiber is less than 90%, this is undesirable in terms of aesthetics that is required in the field of garments, and such a fiber cannot be dyed in a desired hue.

In the invention, the degree of dye exhaustion of the meta-type wholly aromatic polyamide fiber after dyeing (dyed fiber) can be achieved when, in the production method described below, the coagulation bath conditions in the coagulation step are adjusted to give a coagulated form having no skin core, and also the dry-heat treatment in the dry-heat treatment step is performed at a specific temperature to give specific fiber orientation and crystallinity. In order to provide a dyed fiber with a degree of dye exhaustion of 90% or more, it is necessary that the coagulation liquid is an aqueous solution of an amide solvent such as N-methyl-2-pyrrolidone (NMP) with a concentration of 45 to 60 mass %, the temperature of the bath liquid is 10 to 35° C., and the dry-heat treatment temperature is within a range of 260 to 330° C., which is equal to or higher than the glass transition temperature (Tg) of the fiber. Further, it is more preferable that the fiber before dyeing (raw fiber) has a Raman orientation index within a range of 1.3 to 2.2 and a crystallinity within a range of 5 to 20%.

Incidentally, "dyeing" for calculating "degree of dye exhaustion" is dyeing by the following dyeing method.

(Dyeing Method)

A dyeing liquid containing 6% owf of a cationic dye (manufactured by Nippon Kayaku, trade name: Kayacryl Blue GSL-ED (B-54)), 0.3 mL/L of acetic acid, 20 g/L of sodium nitrate, 70 g/L of benzyl alcohol as a carrier agent, and 0.5 g/L of a dyeing assistant (manufactured by Meisei Chemical Works, trade name: DISPER TL) as a dispersant is prepared.

Subsequently, a dyeing treatment is performed at 120° C. for 60 minutes at a bath ratio between a fiber and the dyeing liquid of 1:40. After the dyeing treatment, reduction clearing is performed at 80° C. for 20 minutes at a bath ratio of 1:20 using a treatment liquid containing 2.0 g/L of hydrosulfite, 2.0 g/L of AMILADIN D (manufactured by Dai-ichi Kogyo Seiyaku, trade name: AMILADIN D), and 1.0 g/L of sodium hydroxide. The fiber is then washed with water and dried to give a dyed fiber.

Incidentally, "degree of dye exhaustion" in the invention is a value obtained by the following method.

(Method for Measuring Degree of Dye Exhaustion)

To the residual dyeing liquid that has dyed the fiber before dyeing (raw fiber), the same volume of dichloromethane as the residual dyeing liquid is added to extract the residual dye. Subsequently, the absorbance of the extract is measured at wavelengths of 670 nm, 540 nm, and 530 nm, and the dye concentration of the extract at each wavelength is calculated from calibration curves for the above three wavelengths previously prepared using a dichloromethane solution having a known dye concentration. The average of the concentrations at the above three wavelengths is taken as the dye concentration of the extract (C). A value obtained by the following equation using the dye concentration before dyeing (Co) is defined as the degree of dye exhaustion (U).

$$\text{Degree of dye exhaustion } (U)=[(Co-C)/Co]\times 100 \quad \text{[Equation 4]}$$

{Strength Retention of Dyed Fiber after Immersion in Aqueous Sulfuric Acid Solution (Acid Resistance)}

It is preferable that the meta-type wholly aromatic polyamide fiber of the invention has a strength retention of 65% or more in the form of a dyed fiber after immersion in a 20 mass % aqueous sulfuric acid solution at 50° C. for 150 hours. The strength retention after immersion in an aqueous sulfuric acid solution is preferably 65% or more, still more preferably 70% or more, and most preferably 75% or more.

The strength retention of a dyed fiber after immersion in an aqueous sulfuric acid solution serves as an index of acid resistance. A strength retention of less than 65% leads to insufficient acid resistance and decreased safety, and thus is undesirable.

In the invention, in order to provide a dyed fiber with a strength retention of 65% or more, in the fiber production process, coagulation bath components or conditions are adjusted to give a coagulated form having no skin core.

Incidentally, a dyed fiber used for the evaluation of "strength retention" is a fiber dyed by the same method as the dyeing method for calculating "degree of dye exhaustion" mentioned above. In addition, "strength retention of a dyed fiber after immersion in an aqueous sulfuric acid solution" in the invention is a value obtained by the following method.

(Calculation Method for Strength Retention after Immersion in Aqueous Sulfuric Acid Solution (Acid Resistance Test)

A 20 mass % aqueous sulfuric acid solution is placed in a separable flask, and a dyed fiber measuring 51 mm is immersed therein. Subsequently, the separable flask is immersed in a constant-temperature water bath, and the temperature is maintained at 50° C. The immersion continues for 150 hours. The breaking strength of the dyed fiber is measured before and after immersion to determine the strength retention of the dyed fiber after immersion.

Incidentally, "breaking strength" for calculating "strength retention of a dyed fiber after immersion in an aqueous sulfuric acid solution (acid resistance)" is a value obtained by the same method as in the measurement of the breaking strength of a fiber before dyeing (raw fiber) mentioned above.

{Light Resistance Retention after Carrier Dyeing}

The meta-type wholly aromatic polyamide fiber of the invention has a light resistance retention of 80% or more after carrier dyeing. The light resistance retention is preferably 85% or more, and particularly preferably 90% or more. When the light resistance retention after carrier dyeing is low, this indicates the shedding of a large amount of light stabilizer during carrier dyeing. In the case where the light resistance retention after dyeing is less than 80%, the light-resistance effect of the product after dyeing is not sufficiently exhibited; therefore, this is undesirable.

Incidentally, "light resistance retention" in the invention is a value obtained by the following method.

(Calculation Method for Light Resistance Retention)

For the evaluation of light resistance, resistance to light-induced discoloration and fading (ΔE*) is determined using light-irradiated staple fiber that has been irradiated in a carbon arc fade meter at 63° C. for 24 hours and unirradiated staple fiber. Resistance to light-induced discoloration and fading (ΔE*) is calculated as follows. First, diffuse reflectance is measured using illuminant D65, −10° observer, and then a lightness index L* value and chromaticness indices a* and b* values are calculated by usual processing. Using the obtained values, calculation is performed in accordance with JIS Z-8730 by the following equation.

$$\Delta E^* = ((\Delta L^*)^2 + (\Delta a^*)^2 + (\Delta b^*)^2)^{1/2} \quad \text{[Equation 5]}$$

"Light resistance retention" is a value calculated by the following equation using the resistance to light-induced discoloration and fading (ΔE*) of staple fiber before and after dyeing.

$$\text{Light resistance retention (\%)} = 100 - [(\Delta E^* \text{after dyeing} - \Delta E^* \text{before dyeing}) / \Delta E^* \text{before dyeing}] \times 100 \quad \text{[Equation 6]}$$

Incidentally, "dyeing" in the evaluation of "light resistance retention" is dyeing by the following method without using a dye.

(Method for Dyeing Fiber for Light Resistance Retention Measurement)

Without using a dye, a dyeing liquid containing 0.3 mL/L of acetic acid, 20 g/L of sodium nitrate, 70 g/L of benzyl alcohol as a carrier agent, and 0.5 g/L of a dyeing assistant (manufactured by Meisei Chemical Works, trade name: DISPER TL) as a dispersant is prepared.

Subsequently, a dyeing treatment is performed at 120° C. for 60 minutes at a bath ratio between a fiber and the dyeing liquid of 1:40. After the dyeing treatment, reduction clearing is performed at 80° C. for 20 minutes at a bath ratio of 1:20 using a treatment liquid containing 2.0 g/L of hydrosulfite, 2.0 g/L of AMILADIN ID (manufactured by Dai-ichi Kogyo Seiyaku, trade name: AMILADIN D), and 1.0 g/L of sodium hydroxide. The fiber is then washed with water and dried to give a dyed fiber.

{Strength Retention of Dyed Fiber after Light Resistance Test (Light Resistance)}

It is preferable that the meta-type wholly aromatic polyamide fiber of the invention has a strength retention (light resistance) of 80% or more after irradiation in a xenon arc fade meter at 63° C. for 40 hours. The strength retention is still more preferably 85% or more, and particularly preferably 90% or more. In the case where the strength retention after light irradiation is less than 80%, the strength of such a fiber cannot be maintained through prolonged exposure to sunlight; therefore, this is undesirable.

In the invention, in order to provide a dyed fiber with a strength retention (light resistance) of 80% or more after a light resistance test, in the fiber production process described below, coagulation bath components or conditions are adjusted to give a coagulated form having no skin core.

Incidentally, a dyed fiber used for the evaluation of "strength retention of a dyed fiber after a light resistance test (light resistance)" is a fiber dyed by the same method as the dyeing method for calculating "degree of dye exhaustion" mentioned above. In addition, "strength retention of a dyed fiber after a light resistance test (light resistance)" is a value obtained by the following method.

(Calculation Method for Strength Retention of Dyed Fiber after Light Resistance Test (Light Resistance))

A dyed fiber is wound around a holder and irradiated in a xenon arc fade meter at 63° C. for 40 hours. The breaking strength of the light-irradiated fiber and that of the unirradiated fiber are measured to determine the strength retention of the dyed fiber after light irradiation.

Incidentally, "breaking strength" for calculating "strength retention of a dyed fiber after a light resistance test (light resistance)" is a value obtained by the same method as in the measurement of the breaking strength of a fiber before dyeing (raw fiber) mentioned above.

<Meta-Type Wholly Aromatic Polyamide>

[Configuration of Meta-Type Wholly Aromatic Polyamide]

A meta-type wholly aromatic polyamide forming the meta-type wholly aromatic polyamide fiber of the invention includes a meta-type aromatic diamine component and a meta-type aromatic dicarboxylic acid component. As long as the object of the invention is not impaired, para-type and other copolymer components may also be copolymerized.

In the invention, in terms of dynamic characteristics, heat resistance, and flame retardancy, it is particularly preferable to use a meta-type wholly aromatic polyamide having a metaphenylene isophthalamide unit as a main component.

In a meta-type wholly aromatic polyamide having a metaphenylene isophthalamide unit, it is preferable that the metaphenylene isophthalamide unit occupies 90 mol % or more of all the repeating units, still more preferably 95 mol % or more, and particularly preferably 100 mol %.

{Raw Materials for Meta-Type Wholly Aromatic Polyamide}

(Meta-Type Aromatic Diamine Component)

Examples of meta-type aromatic diamine components to serve as raw materials for the meta-type wholly aromatic polyamide include metaphenylene diamine, 3,4'-diaminodiphenyl ether, and 3,4'-diaminodiphenylsulfone, as well as derivatives having on these aromatic rings substituents such as halogens and $C_{1-3}$ alkyl groups, including 2,4-toluoylenediamine, 2,6-toluoylenediamine, 2,4-diaminochlorobenzene, 2,6-diaminochlorobenzene, etc. Among them, it is preferable to use metaphenylene diamine alone or a diamine mixture containing metaphenylene diamine in an amount of 90 mol % or more, preferably 95 mol % or more.

(Meta-Type Aromatic Dicarboxylic Acid Component)

The meta-type aromatic dicarboxylic acid component as a raw material forming the meta-type wholly aromatic polyamide may be a meta-type aromatic dicarboxylic acid halide, for example. Examples of meta-type aromatic dicarboxylic acid halides include isophthaloyl halides such as isophthaloyl chloride and isophthaloyl bromide, as well as derivatives having on these aromatic rings substituents such as halogens and $C_{1-3}$ alkoxy groups, including 3-chloroisophthaloyl chloride, etc. Among them, it is preferable to use isophthaloyl chloride itself or a carboxylic acid halide mixture containing isophthaloyl chloride in an amount of 90 mol % or more, preferably 95 mol % or more.

(Copolymer Components)

Examples of copolymer components that can be used in addition to the meta-type aromatic diamine component and meta-type aromatic dicarboxylic acid component mentioned above are as follows. Examples of aromatic diamines include benzene derivatives such as paraphenylenediamine, 2,5-diaminochlorobenzene, 2,5-diaminobromobenzene, and amino anisidine, 1,5-naphthylenediamine, 4,4'-diaminodiphenyl ether, 4,4'-diaminodiphenyl ketone, 4,4'-diaminodiphenylamine, and 4,4'-diaminodiphenylmethane. Meanwhile, examples of aromatic dicarboxylic acid components include terephthaloyl chloride, 1,4-naphthalenedicarboxylic acid chloride, 2,6-naphthalenedicarboxylic acid chloride, 4,4'-biphenyldicarboxylic acid chloride, and 4,4'-diphenyl ether dicarboxylic acid chloride.

When the copolymerization proportions of these copolymer components are too high, this is likely to cause loss of the characteristics of the meta-type wholly aromatic polyamide. Therefore, it is preferable that the proportions are each 10 mol % or less based on the total diamine and acid components of the polyamide. In particular, as mentioned above, preferred meta-type wholly aromatic polyamides are polyamides in which a metaphenylene isophthalamide unit occupies 90 mol % or more of all the repeating units. Among them, polymetaphenylene isophthalamide is particularly preferable.

[Method for Producing Meta-Type Wholly Aromatic Polyamide]

The method for producing a meta-type wholly aromatic polyamide is not particularly limited. For example, it can be produced by solution polymerization, interfacial polymerization, or the like using a meta-type aromatic diamine component and a meta-type aromatic dicarboxylic acid chloride component as raw materials.

Incidentally, the molecular weight of the meta-type wholly aromatic polyamide for use in the invention is not particularly limited as long as it allows fibers to be formed. Generally, in order to obtain fibers having sufficient physical properties, a polymer having an intrinsic viscosity (I. V.) within a range of 1.0 to 3.0 as measured in concentrated sulfuric acid at a polymer concentration of 100 mg/100 mL of sulfuric acid at 30° C. is suitable, and a polymer having an intrinsic viscosity within a range of 1.2 to 2.0 is particularly preferable.

<Method for Producing Meta-Type Wholly Aromatic Polyamide Fiber>

Using a meta-type wholly aromatic polyamide obtained by the above production method, the meta-type wholly aromatic polyamide fiber of the invention is produced through, for example, the spinning solution preparation step, spinning/coagulation step, plastic-stretching-bath stretching step, washing step, relaxation treatment step, and heat treatment step described below.

[Spinning Solution Preparation Step]

In a spinning solution preparation step, the meta-type wholly aromatic polyamide is dissolved in an amide solvent, and a UV absorber is added thereto to prepare a spinning solution (meta-type wholly aromatic polyamide polymer solution). In the invention, it is important to add a specific UV absorber to a spinning solution in the spinning solution preparation step. When a fiber is formed from a spinning solution containing the specific UV absorber, the elution of the UV absorber during carrier dyeing can be suppressed.

In the preparation of a spinning solution, usually, an amide solvent is used. Examples of amide solvents used include N-methyl-2-pyrrolidone (NMP), dimethylformamide (DMF), and dimethylacetamide (DMAc). Among them, it is preferable to use NMP or DMAc in terms of solubility and handling safety.

As the solution concentration, an appropriate concentration may be suitably selected in view of the coagulation rate in the subsequent spinning/coagulation step and the solubility of the polymer. For example, in the case where the polymer is polymetaphenylene isophthalamide and the solvent is NMP, it is usually preferable that the concentration is within a range of 10 to 30 mass-%.

(UV Absorber)

It is necessary that a UV absorber for use in the invention is highly hydrophobic, having a water solubility of less than 0.04 mg/L. When the water solubility is 0.04 mg/L or more, such a UV absorber elutes during carrier dyeing, resulting in decreased light resistance after dyeing; therefore, this is undesirable.

In addition, it is preferable that the UV absorber for use in the invention is a compound that efficiently shields light near 360 nm, which is the photodegradation characteristic wavelength of meta-wholly aromatic polyamides, and has almost no absorption in the visible region.

Therefore, as the UV absorber for use in the invention, a specific substituted benzotriazole is preferable. Specific examples thereof include 2-(2H-benzotriazol-2-yl)-4,6-di-tert-pentylphenol, 2-[5-chloro(2H)-benzotriazol-2-yl]-4-methyl-6-(tert-butyl)phenol, 2-[2H-benzotriazol-2-yl]-4-6-bis(1-methyl-1-phenylethyl)phenol, and 2-[2H-benzotriazol-2-yl]-4-(1,1,3,3-tetramethylbutyl)phenol. Among these, 2-[2H-benzotriazol-2-yl]-4-6-bis(1-methyl-1-phenylethyl)phenol is particularly preferable because of the high hydrophobicity and the low absorption in the visible region.

The amount of UV absorber contained in the meta-type wholly aromatic polyamide fiber is preferably within a range of 3.0 mass % or more and 6.5 mass % or less, still more preferably within a range of 4.5 mass or more and 6.5 mass % or less, based on the total mass of the meta-type wholly aromatic polyamide fiber. In the case where the amount is less than 3.0 mass %, the light-resistance effect is not sufficiently exhibited; therefore, this is undesirable. In the case where the amount is more than 6.5 mass %, the physical properties of the resulting raw staple fiber deteriorate; therefore, this is undesirable.

The method for mixing a meta-type wholly aromatic polyamide and a UV absorber is not particularly limited, and may be a method in which a UV absorber is mixed with and dissolved in a solvent followed by the addition of a meta-type wholly aromatic polyamide solution, a method in which a UV absorber is dissolved in a meta-type wholly aromatic polyamide solution, or the like. The spinning solution thus obtained is formed into a fiber through the following step.

[Spinning/Coagulation Step]

In a spinning/coagulation step, the spinning solution obtained above (meta-type wholly aromatic polyamide polymer solution) is extruded into a coagulation liquid and coagulated.

The spinning apparatus is not particularly limited and may be a conventionally known wet-spinning apparatus. In addition, as long as stable wet spinning can be performed, there is no need to limit the number or arrangement of spinning holes of a spinneret, the hole shape, etc. For example, it is possible to use a multi-hole spinneret for staple fibers, in which the number of holes is 500 to 30,000 and the spinning hole diameter is 0.05 to 0.2 mm, etc.

In addition, with respect to the temperature of the spinning solution (meta-type wholly aromatic polyamide polymer solution) when extruded from a spinneret, a range of 10 to 90° C. is suitable.

For a coagulation bath used to obtain the fiber of the invention, an inorganic-salt-free aqueous solution of an amide solvent such as N-methyl-2-pyrrolidone (NMP) with a concentration of 45 to 60 mass % is used at a bath liquid temperature within a range of 10 to 35° C. An amide solvent concentration of less than 45 mass % leads to a structure with a thick skin. As a result, the washing efficiency in a washing step decreases, making it difficult to provide a fiber before dyeing (raw fiber) with a residual solvent content of 0.1 mass % or less. In addition, in the case where the amide solvent concentration is more than 60 mass %, coagulation that is uniform even inside a fiber cannot be achieved. This makes it difficult to provide a fiber before dyeing (raw fiber) with a residual solvent content of 0.1 mass % or less and also leads to insufficient acid resistance. Incidentally, with respect to the time of fiber immersion in the coagulation bath, a range of 0.1 to 30 seconds is suitable.

In the invention, when the components or conditions of the coagulation bath are selected as above, the skin formed on the fiber surface is thin, and also the structure is uniform even inside the fiber. As a result, dye affinity can be further improved. In addition, the obtained fiber can be provided with improved elongation at break and also with improved strength retention in the form of a dyed fiber after a light resistance test (light resistance).

[Plastic-Stretching-Bath Stretching Step]

In a plastic-stretching-bath stretching step, while the fiber obtained by coagulation in the coagulation bath is still plastic, the fiber is subjected to a stretching treatment in a plastic stretching bath.

The plastic stretching bath liquid is not particularly limited and may be a conventionally known bath liquid.

In order to obtain the fiber of the invention, it is necessary that the draw ratio in the plastic stretching bath is within a range of 3.5 to 5.0, still more preferably within a range of 3.7 to 4.5. In the case where the draw ratio in the plastic stretching bath is less than 3.5, the coagulated yarn is not sufficiently desolvated, making it difficult to provide a fiber before dyeing (raw fiber) with a residual solvent content of 0.1 mass % or less. In addition, the fiber before dyeing (raw fiber) is not sufficiently oriented, resulting in insufficient breaking strength, and such a fiber is difficult to handle in a processing step such as a spinning step. Meanwhile, in the case where the draw ratio is more than 5.0, single-yarn breakage occurs, resulting in decreased production stability. In addition, the Raman orientation index of the fiber before dyeing (raw fiber) increases, resulting in decreased dye affinity.

It is preferable that the temperature of the plastic stretching bath is within a range of 10 to 90° C. Preferably, a temperature within a range of 20 to 90° C. leads to good process conditions.

[Washing Step]

In a washing step, the fiber stretched in the plastic stretching bath is thoroughly washed. Washing affects the quality of the resulting fiber and thus is preferably performed in several stages. In particular, in the washing step, the temperature of a washing bath and the amide solvent concentration of a washing bath liquid affect the condition of extraction of the amide solvent from a fiber and also the condition of ingress of water into a fiber from the washing bath. Therefore, also for the purpose of optimizing these conditions, it is preferable that the washing step is carried out in several stages to control the temperature conditions and the amide solvent concentration conditions.

The temperature conditions and the amide solvent concentration conditions are not particularly limited as long as the fiber finally obtained can be provided with satisfactory quality. However, when the temperature of the first washing bath is as high as 60° C. or more, water rapidly enters the fiber, whereby huge voids are formed in the fiber, causing the deterioration of quality. Therefore, it is preferable that the temperature of the first washing bath is as low as 30° C. or less.

The presence of residual solvent in the fiber is undesirable in terms of environmental safety in the processing of a product using the fiber or the use of a product formed using the fiber. Therefore, the amount of solvent contained in the fiber of the invention is 0.1 mass or less, still more preferably 0.08 mass or less.

[Dry-Heat Treatment Step]

In a dry-heat treatment step, the fiber that has undergone the washing step is dried and heat-treated. The dry-heat treatment method is not particularly limited, and may be a method using a hot roller, a hot plate, or the like, for example. Through the dry-heat treatment, finally, the meta-type wholly aromatic polyamide fiber of the invention can be obtained.

In order to obtain the fiber of the invention, it is necessary that the heat treatment temperature in the dry-heat treatment step is within a range of 260 to 330° C., still more preferably 270 to 310° C. In the case where the heat treatment temperature is less than 260° C., fiber crystallinity is insufficient. Such a fiber has high shrinkability and thus is difficult to handle in the dyeing step. Meanwhile, in the case where it is more than 330° C., fiber crystallinity is so high that dye affinity significantly decreases, making it difficult to provide a dyed fiber with a degree of dye exhaustion of 90% or more. In addition, a dry-heat treatment temperature within a range of 260 to 330° C. contributes to the improvement of the breaking strength of the resulting fiber.

<Dyeing Treatment>

For the dyeing treatment of the meta-type wholly aromatic polyamide fiber of the invention, existing synthetic fiber dyeing facilities may be used. Incidentally, the dye used for the dyeing treatment is not particularly limited, but it is preferable to use a cationic dye that easily penetrates into a dense structure and allows for a high degree of dye exhaustion.

In addition, in order to dye the meta-type wholly aromatic polyamide fiber of the invention, it is necessary to use a carrier, which is a dyeing assistant. In the case where no carrier is used, the dye cannot thoroughly penetrate into the dense structure of a fiber, resulting in a decreased degree of dye exhaustion; therefore, this is undesirable.

EXAMPLES

Hereinafter, the invention will be described in further detail with reference to examples, etc. However, the invention is not limited to these examples, etc.

<Measurement Method>

Physical property values in the examples and comparative examples were measured by the following methods.

(1) Intrinsic Viscosity (IV)

An aromatic polyamide polymer was isolated from a polymer solution, dried, and then subjected to measurement in concentrated sulfuric acid at a polymer concentration of 100 mg/100 mL of sulfuric acid at 30° C.

(2) Fineness

In accordance with JIS L1015, fineness was measured by the Method A of Fineness Based on Corrected Mass and expressed in apparent fineness.

(3) Breaking Strength and Elongation at Break of Fiber before Dyeing (Raw Fiber)

Measurement was performed in accordance with JIS L1015 using Model 5565 manufactured by Instron under the following conditions.

(Measurement Conditions)

Grip distance: 20 mm

Initial load: 0.044 cN (1/20 g)/dtex

Tensile rate: 20 mm/min (4) Residual Solvent Content of Fiber before Dyeing (Raw Fiber)

About 8.0 g of a fiber before dyeing (raw fiber) was collected, dried at 105° C. for 120 minutes, and then allowed to cool in a desiccator, and the fiber mass (M1) was measured. Subsequently, the fiber before dyeing (raw fiber) was subjected to reflux extraction in methanol for 1.5 hours using a Soxhlet extractor to extract the amide solvent contained in the fiber. After extraction, the fiber was removed, vacuum-dried at 150° C. for 60 minutes, and then allowed to cool in a desiccator, and the fiber mass (M2) was measured. Using the obtained M1 and M2, the amount of residual solvent in the fiber (amide solvent mass) N (%) was calculated by the following equation.

$$N(\%)=[(M1-M2)/M1]\times 100 \quad \text{[Equation 7]}$$

(5) Raman Orientation Index

A fiber before dyeing (raw fiber) was fixed to a sample holder, and measurement was performed using a single laser micro-Raman spectrometer (manufactured by Jobin-Yvon, model: T64000) under the following conditions: a solid-state laser ($\lambda$=785 nm), output: 76 mW. "Raman orientation index" was calculated by the following equation using the peak polarization anisotropy near a Raman shift wavenumber of 1,000 $cm^{-1}$, which is the meta-type wholly aromatic polyamide eigenvalue.

$$\text{Raman orientation index}=[XX\ \text{Raman intensity}/YY\ \text{Raman intensity}] \quad \text{[Equation 8]}$$

(In the equation, XX indicates that the incident polarization plane and the detection polarization plane are parallel to the fiber axis, and YY indicates that the incident polarization plane and the detection polarization plane are perpendicular to the fiber axis.)

(6) Crystallinity

Crystallinity was converted from the profile of a fiber before dyeing (raw fiber) in the form of a bundle about 1 mm in diameter, which was measured using an X-ray diffraction apparatus (trade name: RIGAKU RINT TTR III) under the following conditions.

(Measurement Conditions)

X-ray source: Cu-K$\alpha$ line

Fiber sample table: 50-rpm rotation

2$\theta$ scan: 5 to 50°

Continuous measurement: 0.1°

Width measurement: scan at 1°/min

Specifically, air scattering and incoherent scattering in the measured diffraction profile were corrected by linear approximation to give the total scattering intensity profile. The undried yarn profile of an amorphous meta-type wholly aromatic polyamide fiber was fit to the obtained total scattering intensity by visual estimation, and the difference was taken as the crystal scattering intensity. Crystallinity was calculated by the following equation using the areas of crystal scattering intensity and total scattering intensity (integrated value).

$$\text{Crystallinity}\ (\%)=[\text{area of crystal scattering intensity}/\text{area of total scattering intensity}]\times 100 \quad \text{[Equation 9]}$$

(7) Degree of Dye Exhaustion of Dyed Fiber

To a residual dyeing liquid that had dyed raw staple fiber, the same volume of dichloromethane as the residual dyeing liquid was added to extract the residual dye. Subsequently, the absorbance of the extract was measured at wavelengths of 670 nm, 540 nm, and 530 nm, and the dye concentration of the extract at each wavelength was calculated from calibration curves for the above three wavelengths previously prepared using a dichloromethane solution having a known dye concentration. The average of the concentrations at the above three wavelengths was taken as the dye concentration of the extract (C). A value obtained by the following equation using the dye concentration before dyeing (Co) was defined as the degree of dye exhaustion (U).

$$\text{Degree of dye exhaustion}\ (U)=[(Co-C)/Co]\times 100 \quad \text{[Equation 10]}$$

Incidentally, "dyeing" for calculating "degree of dye exhaustion" was performed by the following dyeing method.

(Dyeing Method)

A dyeing liquid containing 6% owf of a cationic dye (manufactured by Nippon Kayaku, trade name: Kayacryl Blue GSL-ED (B-54)), 0.3 mL/L of acetic acid, 20 g/L of sodium nitrate, 70 g/L of benzyl alcohol as a carrier agent, and 0.5 g/L of a dyeing assistant (manufactured by Meisei Chemical Works, trade name: DISPER TL) as a dispersant was prepared.

Subsequently, a dyeing treatment was performed at 120° C. for 60 minutes at a bath ratio between raw staple fiber and the dyeing liquid of 1:40. After the dyeing treatment, reduction clearing was performed at 80° C. for 20 minutes at a bath ratio of 1:20 using a treatment liquid containing 2.0 g/L of hydrosulfite, 2.0 g/L of AMILADIN D (manufactured by Dai-ichi Kogyo Seiyaku, trade name: AMILADIN D), and 1.0 g/L of sodium hydroxide. The staple fiber was then washed with water and dried to give dyed raw staple fiber.

(8) Strength Retention of Dyed Fiber after Immersion in Aqueous Sulfuric Acid Solution (Acid Resistance)

A 20 mass % aqueous sulfuric acid solution was placed in a separable flask, and a dyed fiber dyed by the same method as the dyeing method for calculating "degree of dye exhaustion" mentioned above was immersed therein. Subsequently, the separable flask was immersed in a constant-temperature water bath, and the temperature was maintained at 50° C. The immersion continued for 150 hours. By the same method as the method for measuring the breaking strength of a fiber before dyeing (raw fiber) mentioned above, the breaking strength of the dyed fiber was measured before and after immersion to determine the strength retention of the dyed fiber after immersion.

(9) Light Resistance Retention after Carrier Dyeing

For the evaluation of light resistance, resistance to light-induced discoloration and fading (ΔE*) was determined using light-irradiated staple fiber that had been irradiated in a carbon arc fade meter at 63° C. for 24 hours and unirradiated staple fiber. Resistance to light-induced discoloration and fading (ΔE*) was calculated as follows. First, diffuse reflectance was measured using illuminant D65, −10° observer, and then a lightness index L* value and chromaticness indices a* and b* values were calculated by usual processing. Using the obtained values, calculation was performed in accordance with JIS Z-8730 by the following equation.

$$\Delta E^* = ((\Delta L^*)^2 + (\Delta a^*)^2 + (\Delta b^*)^2)^{1/2} \quad \text{[Equation 11]}$$

"Light resistance retention" is a value calculated by the following equation using the resistance to light-induced discoloration and fading (ΔE*) of staple fiber before and after dyeing.

$$\text{Light resistance retention (\%)} = 100 - [(\Delta E^* \text{after dyeing} - \Delta E^* \text{before dyeing}) / \Delta E^* \text{before dyeing}] \times 100 \quad \text{[Equation 12]}$$

Incidentally, as "dyeing" in the evaluation of light resistance retention, dyeing was performed by the following method without using a dye.

(Method for Dyeing Fiber for Light Resistance Retention Measurement)

Without using a dye, a dyeing liquid containing 0.3 mL/L of acetic acid, 20 g/L of sodium nitrate, 70 g/L of benzyl alcohol as a carrier agent, and 0.5 g/L of a dyeing assistant (manufactured by Meisei Chemical Works, trade name: DISPER TL) as a dispersant was prepared.

Subsequently, a dyeing treatment was performed at 120° C. for 60 minutes at a bath ratio between raw staple fiber and the dyeing liquid of 1:40. After the dyeing treatment, reduction clearing was performed at 80° C. for 20 minutes at a bath ratio of 1:20 using a treatment liquid containing 2.0 g/L of hydrosulfite, 2.0 g/L of AMILADIN D (manufactured by Dai-ichi Kogyo Seiyaku, trade name: AMILADIN D), and 1.0 g/L of sodium hydroxide. The staple fiber was then washed with water and dried to give dyed raw staple fiber.

(10) Strength Retention of Dyed Fiber after Light Resistance Test (Light Resistance)

A dyed fiber dyed by the same method as the dyeing method for calculating "degree of dye exhaustion" mentioned above was wound around a holder and irradiated in a xenon arc fade meter at 63° C. for 40 hours. By the same method as the method for measuring the breaking strength of a fiber before dyeing (raw fiber) mentioned above, the breaking strength of the light-irradiated fiber and that of the unirradiated fiber were measured to determine the strength retention of the dyed fiber after light irradiation.

Example 1

Spinning Solution Preparation Step 20.0 parts by mass of a polymetaphenylene isophthalamide powder having an intrinsic viscosity (I. V.) of 1.9 produced by interfacial polymerization according to the method described in JP-B-47-10863 was suspended in 80.0 parts by mass of N-methyl-2-pyrrolidone (NMP) cooled to −10° C., thereby forming a slurry. Subsequently, the suspension was heated to 60° C. for dissolution to give a transparent polymer solution.

A 2-[2H-benzotriazol-2-yl]-4-6-bis(1-methyl-1-phenylethyl)phenol powder (water solubility: 0.01 mg/L) in an amount of 1.0 mass % relative to the polymer was mixed with and dissolved in the polymer solution, and degassed under reduced pressure to give a spinning solution (spinning dope).

[Spinning/Coagulation Step]

The spinning dope was discharged and spun from a spinneret (hole diameter: 0.07 mm, the number of holes: 500) into a coagulation bath having a bath temperature of 30° C. The composition of the coagulation liquid was as follows: water/NMP=45/55 (part by mass). The discharging and spinning into the coagulation bath was performed at a yarn speed of 7 m/min.

[Plastic-Stretching-Bath Stretching Step]

Subsequently, stretching was performed to a draw ratio of 3.7 in a plastic stretching bath at a temperature of 40° C. having the following composition: water/NMP=45/55.

[Washing Step]

After stretching, washing was performed in a bath at 20° C. and water/NMP=70/30 (immersion length: 1.8 m) and then in a water bath at 20° C. (immersion length: 3.6 m), followed by thorough washing through a hot water bath at 60° C. (immersion length: 5.4 m).

[Dry-Heat Treatment Step]

The fiber after washing was subjected to a dry-heat treatment using a hot roller having a surface temperature of 280° C. to give a meta-type wholly aromatic aramid fiber.

[Physical Properties of Fiber before Dyeing (Raw Fiber)]

The physical properties of the obtained fiber before dyeing (raw fiber) were as follows: fineness: 1.7 dtex, breaking strength: 2.9 cN/dtex, elongation at break: 52.0%, residual solvent content: 0.08 mass %. Thus, excellent dynamic characteristics were shown. Table 1 shows the physical properties of the obtained fiber before dyeing (raw fiber) together with the results of structural analysis.

[Crimping and Cutting Step]

The obtained fiber was crimped through a crimper, and then cut with a cutter into 51-mm staple fibers to give raw staple fiber.

[Dyeing Step 1]

A dyeing liquid containing 6% owf of a cationic dye (manufactured by Nippon Kayaku, trade name: Kayacryl Blue GSL-ED (B-54)), 0.3 mL/L of acetic acid, 20 g/L of sodium nitrate, 70 g/L of benzyl alcohol as a carrier agent, and 0.5 g/L of a dyeing assistant (manufactured by Meisei Chemical Works, trade name: DISPER TL) as a dispersant was prepared.

The obtained raw staple fiber was subjected to a dyeing treatment at 120° C. for 60 minutes at a bath ratio between the raw staple fiber and the dyeing liquid of 1:40. After the dyeing treatment, reduction clearing was performed at 80° C. for 20 minutes at a bath ratio of 1:20 using a treatment liquid containing 2.0 g/L of hydrosulfite, 2.0 g/L of AMILADIN D (manufactured by Dai-ichi Kogyo Seiyaku, trade name: AMILADIN D), and 1.0 g/L of sodium hydroxide. The staple fiber was then washed with water and dried to give dyed staple fiber.

[Physical Properties of Dyed Staple fiber, Etc.]

The degree of dye exhaustion of the dyed staple fiber was 91.2%, showing excellent dye affinity. In addition, the breaking strength of the dyed staple fiber was 2.9 cN/dtex, and the breaking strength of the dyed staple fiber after an acid resistance test was 1.8 cN/dtex. Strength retention after immersion in an aqueous sulfuric acid solution (after an acid resistance test) was thus 62%, showing excellent acid resistance. In addition, strength retention after a light resistance test was 80%. The results are shown in Table 1.

[Dyeing Step 2]

Without using a dye, a dyeing liquid containing 0.3 mL/L of acetic acid, 20 g/L of sodium nitrate, 70 g/L of benzyl alcohol as a carrier agent, and 0.5 g/L of a dyeing assistant (manufactured by Meisei Chemical Works, trade name: DISPER TL) as a dispersant was prepared.

The obtained raw staple fiber was subjected to a dyeing treatment at 120° C. for 60 minutes at a bath ratio between the raw staple fiber and the dyeing liquid of 1:40. After the dyeing treatment, reduction clearing was performed at 80° C. for 20 minutes at a bath ratio of 1:20 using a treatment liquid containing 2.0 g/L of hydrosulfite, 2.0 g/L of AMILADIN D (manufactured by Dai-ichi Kogyo Seiyaku, trade name: AMILADIN D), and 1.0 g/L of sodium hydroxide. The staple fiber was then washed with water and dried to give dyed staple fiber.

[Light Resistance Retention]

The light resistance retention of the obtained raw staple fiber after carrier dyeing was 95%. The results are shown in Table 1.

Example 2

Spinning Solution Preparation Step 854.8 parts of N-methyl-2-pyrrolidone (hereinafter abbreviated as NMP) was placed in a reactor equipped with a stirring apparatus and a raw material inlet, and 83.4 parts of metaphenylene diamine (hereinafter abbreviated as MPDA) was dissolved in this NMP. Further, 156.9 parts of isophthaloyl chloride (hereinafter abbreviated as IPC) was slowly added to the solution with stirring to cause a reaction. After stirring was continued for 40 minutes from the start of the reaction, 57.1 parts of a calcium hydroxide powder was added and further stirred for 40 minutes, and then the reaction was terminated. The polymerization solution was removed from the reactor. As a result, the polymerization solution was transparent and had a polymer concentration of 16%.

A 2-[2H-benzotriazol-2-yl]-4-6-bis(1-methyl-1-phenylethyl)phenol powder (water solubility: 0.01 mg/L) in an amount of 3.0 mass % relative to the polymer was mixed with and dissolved in the polymer solution, and degassed under reduced pressure to give a spinning solution (spinning dope).

[Spinning/Coagulation Step, Plastic-Stretching-Bath Stretching Step, Washing Step, Dry-Heat Treatment Step]

A polymetaphenylene isophthalamide fiber was obtained in the same manner as in Example 1, except that the obtained polymerization solution was used as a raw spinning dope, the draw ratio in the plastic stretching bath was 3.7, and the surface temperature in the dry-heat treatment step was 310° C.

[Physical Properties of Fiber before Dyeing (Raw Fiber)]

The physical properties of the obtained fiber were as follows: fineness: 1.7 dtex, breaking strength: 2.7 cN/dtex, elongation at break: 50.0%, residual solvent content: 0.08 mass %. Table 1 shows the physical properties of the obtained fiber together with the results of structural analysis.

[Crimping and Cutting Step]

The obtained fiber was crimped and cut in the same manner as in Example 1.

[Dyeing Step 1]

The obtained raw staple fiber was subjected to a dyeing step 1 in the same manner as in Example 1.

[Physical Properties of Dyed Staple Fiber, etc.]

The degree of dye exhaustion was 92.4%, showing excellent dye affinity. In addition, the breaking strength of the dyed staple fiber was 2.7 cN/dtex, and the breaking strength of the dyed staple fiber after an acid resistance test was 2.3 cN/dtex. Strength retention after immersion in an aqueous sulfuric acid solution (after an acid resistance test) was thus 67%, showing excellent acid resistance. In addition, strength retention after a light resistance test was 85%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 89%. The results are shown in Table 1.

Example 3

Production of Fiber before Dyeing (Raw Fiber)

A polymetaphenylene isophthalamide fiber was obtained in the same manner as in Example 2, except that the amount of 2-[2H-benzotriazol-2-yl]-4-6-bis(1-methyl-1-phenylethyl)phenol (water solubility: 0.01 mg/L) added was 5.0 mass % relative to the polymer.

[Physical Properties of Fiber before Dyeing (Raw Fiber)]

The physical properties of the obtained fiber were as follows: fineness: 1.7 dtex, breaking strength: 2.6 cN/dtex, elongation at break: 47.8%, residual solvent content: 0.07 mass %. Table 1 shows the physical properties of the obtained fiber together with the results of structural analysis.

[Crimping and Cutting Step]

The obtained fiber was crimped and cut in the same manner as in Example 1.

[Dyeing Step 1]

The obtained fiber was subjected to a dyeing step in the same manner as in Example 1.

[Physical Properties of Dyed Staple Fiber, Etc.]

The degree of dye exhaustion was 91.0%, showing excellent dye affinity. In addition, the breaking strength of the dyed staple fiber was 2.6 cN/dtex, and the breaking strength of the dyed staple fiber after an acid resistance test was 1.9 cN/dtex. Strength retention after immersion in an aqueous sulfuric acid solution (after an acid resistance test) was thus 73%, showing excellent acid resistance. In addition, strength retention after a light resistance test was 89%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 91%. The results are shown in Table 1.

Example 4

Production of Fiber before Dyeing (Raw Fiber)

A polymetaphenylene isophthalamide fiber was obtained in the same manner as in Example 2, except that the amount of 2-[2H-benzotriazol-2-yl]-4-6-bis(1-methyl-1-phenylethyl)phenol (water solubility: 0.01 mg/L) added was 6.5 mass % relative to the polymer.

[Physical Properties of Fiber before Dyeing (Raw Fiber)]

The physical properties of the obtained fiber were as follows: fineness: 1.7 dtex, breaking strength: 2.5 cN/dtex, elongation at break: 44.3%, residual solvent content: 0.08 mass %. Table 1 shows the physical properties of the obtained fiber together with the results of structural analysis.

[Crimping and Cutting Step]

The obtained fiber was crimped and cut in the same manner as in Example 1.

[Dyeing Step 1]

The obtained fiber was subjected to a dyeing step in the same manner as in Example 1.

[Physical Properties of Dyed Staple Fiber, Etc.]

The degree of dye exhaustion was 91.5%, showing excellent dye affinity. In addition, the breaking strength of the dyed staple fiber was 2.5 cN/dtex, and the breaking strength of the dyed staple fiber after an acid resistance test was 1.8 cN/dtex. Strength retention after immersion in an aqueous sulfuric acid solution (after an acid resistance test) was thus 72%, showing excellent acid resistance. In addition, strength retention after a light resistance test was 90%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 93%. The results are shown in Table 1.

Example 5

Production of Fiber before Dyeing (Raw Fiber)

A polymetaphenylene isophthalamide fiber was obtained in the same manner as in Example 2, except that the amount of 2-[2H-benzotriazol-2-yl]-4-6-bis(1-methyl-1-phenylethyl)phenol (water solubility: 0.01 mg/L) added was 8.0 mass % relative to the polymer.

Physical Properties of Fiber before Dyeing (Raw Fiber)

The physical properties of the obtained fiber were as follows: fineness: 1.7 dtex, breaking strength: 2.3 cN/dtex, elongation at break: 33.1%, residual solvent content: 0.08 mass %. Table 1 shows the physical properties of the obtained fiber together with the results of structural analysis.

[Crimping and Cutting Step]

The obtained fiber was crimped and cut in the same manner as in Example 1.

[Dyeing Step 1]

The obtained fiber was subjected to a dyeing step in the same manner as in Example 1.

[Physical Properties of Dyed Staple fiber, Etc.]

The degree of dye exhaustion was 93.4%, showing excellent dye affinity. In addition, the breaking strength of the dyed staple fiber was 2.3 cN/dtex, and the breaking strength of the dyed staple fiber after an acid resistance test was 1.5 cN/dtex. Strength retention after immersion in an aqueous sulfuric acid solution (after an acid resistance test) was thus 65%, showing excellent acid resistance. In addition, strength retention after a light resistance test was 91%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 95%. The results are shown in Table 1.

Comparative Example 1

A polymetaphenylene isophthalamide fiber was obtained in the same manner as in Example 2, except that methyl 3-(3-(2H-benzotriazol-2-yl)-5-t-butyl-4-hydroxyphenyl) propionate (water solubility: 0.05 mg/L) having high hydrophilicity was used as a UV absorber.

[Physical Properties of Fiber before Dyeing (Raw Fiber)]

The physical properties of the obtained fiber were as follows: fineness: 1.7 dtex, breaking strength: 2.9 cN/dtex, elongation at break: 49.8%, residual solvent content: 0.10 mass %. Table 1 shows the physical properties of the obtained fiber together with the results of structural analysis.

[Crimping and Cutting Step]

The obtained fiber was crimped and cut in the same manner as in Example 1.

[Dyeing Step 1]

The obtained raw staple fiber was subjected to a dyeing step in the same manner as in Example 1.

[Physical Properties of Dyed Fiber, Etc.]

The degree of dye exhaustion was 91.2%, showing excellent dye affinity. In addition, the breaking strength of the dyed staple fiber was 2.9 cN/dtex, and the breaking strength of the dyed staple fiber after an acid resistance test was 2.2 cN/dtex. Strength retention after immersion in an aqueous sulfuric acid solution (after an acid resistance test) was thus 76%, showing excellent acid resistance. However, strength retention after a light resistance test was 66%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 52%. Because of the high hydrophilicity of the UV absorber, the UV absorber had eluted during dyeing. The results are shown in Table 1.

Comparative Example 2

Production of Fiber before Dyeing (Raw Fiber)

A meta-type wholly aromatic polyamide fiber dyeable without a carrier was produced according to the method described in JP-A-8-81827. The fiber contains the following components: dodecylbenzenesulfonic acid tributylbenzylammonium salt, 13.0 mass % relative to the polymer; 2-[2H-benzotriazol-2-yl]-4-6-bis(1-methyl-1-phenylethyl)phenol water solubility: 0.01 mg/L), 5.0 mass % relative to the polymer; and a non-halogenated aromatic phosphate ester (CR741) manufactured by Daihachi Chemical Industry, 7.5 mass % relative to the polymer.

[Physical Properties of Fiber before Dyeing (Raw Fiber)]

The physical properties of the obtained fiber before dyeing (raw fiber) were as follows: fineness: 1.9 dtex, breaking strength: 3.4 cN/dtex, elongation at break: 51.1%, residual solvent content: 1.70 mass %. Table 1 shows the physical properties of the obtained fiber before dyeing (raw fiber) together with the results of structural analysis.

[Crimping and Cutting Step]

The obtained fiber was crimped and cut in the same manner as in Example 1.

[Dyeing Step 1]

The obtained raw staple fiber was subjected to a dyeing step in the same manner as in Example 1.

[Physical Properties of Dyed Fiber, Etc.]

The degree of dye exhaustion was 71.3%, indicating insufficient carrier dyeing properties. The breaking strength of the dyed staple fiber was 3.4 cN/dtex, and the breaking strength of the dyed staple fiber after an acid resistance test was 2.0 cN/dtex. Strength retention after immersion in an aqueous sulfuric acid solution (after an acid resistance test) was thus 59%; therefore, the results of acid resistance were also insufficient. In addition, strength retention after a light resistance test was 74%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 65%. The results are shown in Table 1.

Comparative Example 3

Spinning Solution Preparation Step

A spinning solution was prepared in the same manner as in Example 2, except that a 2-[2H-benzotriazol-2-yl]-4-6-bis(1-methyl-1-phenylethyl)phenol powder was not added.

[Production of Fiber before Dyeing (Raw Fiber)]

Spinning/coagulation, plastic-stretching-bath stretching, and washing were performed in the same manner as in Example 2 to give a wet meta-type wholly aromatic polyamide fiber immediately after the washing step.

[UV-Shielding Agent Impregnation Step]

In 10 mL of methylene chloride was dissolved 7 mass % of methyl 3-(3-(2H-benzotriazol-2-yl)-5-t-butyl-4-hydroxyphenyl)propionate (water solubility: 0.05 mg/L). The solution was poured with stirring into 100 mL of an aqueous solution having dissolved therein 0.3 g of an emulsifier "EMCOL P10-59". Stirring was continued until methylene chloride completely evaporated to give an aqueous dispersion of methyl 3-(3-(2H-benzotriazol-2-yl)-5-t-butyl-4-hydroxyphenyl)propionate (water solubility: 0.05 mg/L).

Next, 20 g of the undried meta-type wholly aromatic polyamide fiber was collected and placed in the aqueous dispersion, and maintained at room temperature for 1 hour with stirring. Subsequently, the mixture was diluted with 100 mL of water, heated to the boiling point, and further maintained at such a temperature for 1 hour. The fiber was removed, washed with water, and subjected to a dry-heat treatment using a hot roller at 310° C.

[Physical Properties of Fiber before Dyeing (Raw Fiber)]

The physical properties of the obtained fiber before dyeing (raw fiber) were as follows: fineness: 1.7 dtex, breaking strength: 2.6 cN/dtex, elongation at break: 47.8%, residual solvent content: 0.03 mass %. Table 1 shows the physical properties of the obtained fiber before dyeing (raw fiber) together with the results of structural analysis.

[Crimping and Cutting Step]

The obtained fiber was crimped and cut in the same manner as in Example 1.

[Dyeing Step 1]

The obtained raw staple fiber was subjected to a dyeing step in the same manner as in Example 1.

[Physical Properties of Dyed Fiber, Etc.]

The degree of dye exhaustion was 91.5%. The breaking strength of the dyed staple fiber was 2.6 cN/dtex, and the breaking strength of the dyed staple fiber after an acid resistance test was 1.9 cN/dtex. Strength retention after immersion in an aqueous sulfuric acid solution (after an acid resistance test) was thus 73%. However, strength retention after a light resistance test was 69%. The results are shown in Table 1.

[Dyeing Step 2]

The obtained raw staple fiber was subjected to a dyeing step 2 in the same manner as in Example 1.

[Light Resistance Retention]

The light resistance retention of the obtained raw staple fiber after carrier dyeing was 64%. A large amount of the UV absorber had eluted. The results are shown in Table 1.

TABLE 1

| | | Example 1 | Example 2 | Example 3 | Example 4 | Example 5 | Comparative Example 1 | Comparative Example 2 | Comparative Example 3 |
|---|---|---|---|---|---|---|---|---|---|
| NMP Composition of Coagulation Bath (water/NMP) | | 45/55 | 45/55 | 45/55 | 45/55 | 45/55 | 45/55 | — | 45/55 |
| Draw Ratio in Plastic Bath | | 3.7 | 3.7 | 3.7 | 3.7 | 3.7 | 3.7 | — | 3.7 |
| Dry-Heat Treatment Temperature (° C.) | | 280 | 280 | 280 | 280 | 280 | 280 | — | 280 |
| Water Solubility of UV Absorber (mg/L) | | 0.01 | 0.01 | 0.01 | 0.01 | 0.01 | 0.05 | 0.01 | 0.05 |
| Concentration of UV Absorber Added (wt %) | | 1.0 | 3.0 | 5.0 | 6.5 | 8.0 | 5.0 | 5.0 | — (Impregnation) |
| Physical Properties of Fiber before Dyeing (Raw Fiber) | Fineness (dtex) | 1.7 | 1.7 | 1.7 | 1.7 | 1.7 | 1.7 | 1.9 | 1.7 |
| | Breaking Strength (cN/dtex) | 2.9 | 2.7 | 2.6 | 2.5 | 2.3 | 2.9 | 3.4 | 2.6 |
| | Elongation at Break (%) | 52.0 | 50.0 | 47.8 | 44.3 | 33.1 | 49.8 | 51.1 | 47.8 |
| | Residual Solvent Content (%) | 0.08 | 0.08 | 0.07 | 0.08 | 0.08 | 0.10 | 1.70 | 0.03 |
| Structural Analysis of Fiber before Dyeing (Raw Fiber) | Raman Orientation Index | 1.89 | 1.83 | 1.75 | 1.77 | 1.79 | 1.92 | 2.23 | 1.85 |
| | Crystallinity (%) | 10 | 9 | 10 | 10 | 8 | 11 | 26 | 11 |
| Physical Properties of Dyed Fiber | Degree of Dye Exhaustion (%) | 91.2 | 92.4 | 91.0 | 91.5 | 93.4 | 91.2 | 71.3 | 91.5 |
| | Breaking Strength before Acid Resistance Test (cN/dtex) | 2.9 | 2.7 | 2.6 | 2.5 | 2.3 | 2.9 | 3.4 | 2.6 |
| | Breaking Strength after Acid Resistance Test (cN/dtex) | 1.8 | 2.3 | 1.9 | 1.8 | 1.5 | 2.2 | 2.0 | 1.9 |
| | Strength Retention after Immersion in Aqueous Sulfuric Acid Solution (%) | 62 | 67 | 73 | 72 | 65 | 76 | 59 | 73 |
| Light Resistance Evaluation | ΔE* before Dyeing | 22.0 | 14.0 | 13.5 | 13.0 | 11.2 | 16.5 | 13.9 | 17.0 |
| | Light Resistance Retention after Carrier Dyeing (%) | 95 | 89 | 91 | 93 | 95 | 52 | 65 | 64 |
| | Single-Yarn Strength Retention after Light Resistance Test (%) | 80 | 85 | 89 | 90 | 91 | 66 | 74 | 69 |

INDUSTRIAL APPLICABILITY

The meta-type wholly aromatic polyamide fiber of the invention serves as a light-resistant fiber, which can be dyed in various hues by carrier dyeing and in which the shedding of a light stabilizer during dyeing can be suppressed. Further, even in the case where the fiber is subjected to prolonged light irradiation such as prolonged exposure to sunlight, deterioration can be suppressed, whereby its strength can be retained. Accordingly, the industrial value of the fiber is extremely high in the fields where dye affinity and light resistance are required. The invention is extremely useful in the fields of bedding, garments, interior design, and the like where aesthetics and visibility are of importance, for example.

The invention claimed is:

1. A meta-type wholly aromatic polyamide fiber comprising a UV absorber with a water solubility of less than 0.04 mg/L, and having:

a crystallinity of 5 to 20%;

a degree of dye exhaustion of 90% or more in the form of a dyed fiber; and a light resistance retention of 80% or more after carrier dyeing;

wherein the degree of dye exhaustion is measured by the following method:

(i) to a residual dyeing liquid that has dyed the fiber before dyeing (raw fiber), the same volume of dichloromethane as the residual dyeing liquid is added to extract the residual dye;

(ii) subsequently, the absorbance of the extract is measured at wavelengths of 670 nm, 540 nm, and 530 nm, and the dye concentration of the extract at each wavelength is calculated from calibration curves for the above three wavelengths previously prepared using a dichloromethane solution having a known dye concentration;

(iii) the average of the concentrations at the above three wavelengths is taken as the dye concentration of the extract (C); and (iv) a value obtained by the following equation 4 using the dye concentration before dyeing (Co) is defined as the degree of dye exhaustion (U):

$$\text{Degree of dye exhaustion } (U)=[(Co-C)/Co]\times 100; \quad \text{[Equation 4]}$$

and wherein the light resistance retention is measured by the following method:

(i) resistance to light-induced discoloration and fading (ΔE*) is determined using light-irradiated staple fiber that has been irradiated in a carbon arc fade meter at 63° C. for 24 hours and unirradiated staple fiber, wherein resistance to light-induced discoloration and fading (ΔE*) is calculated as follows:

(a) first, diffuse reflectance is measured using illuminant D65, −10° observer, (b) then, a lightness index L* value and chromaticness indices a* and b* values are calculated by usual processing; and (c) using the obtained values, calculation is performed in accordance with JIS Z-8730 by the following equation 5:

$$\Delta E^*=((\Delta L^*)^2+(\Delta a^*)^2+(\Delta b^*)^2)^{1/2}; \quad \text{[Equation 5]}$$

and (ii) light resistance retention is a value calculated by the following equation 6 using the resistance to light-induced discoloration and fading (ΔE*) of staple fiber before and after dyeing:

$$\text{Light resistance retention } (\%)=100-[(\Delta E^*\text{after dyeing}-\Delta E^*\text{before dyeing})/\Delta E^*\text{before dyeing}]\times 100. \quad \text{[Equation 6]}$$

2. The meta-type wholly aromatic polyamide fiber according to claim 1, having a Raman orientation index of 1.3 to 2.2.

3. The meta-type wholly aromatic polyamide fiber according to claim 1, having a strength retention of 80% or more after irradiation in a xenon arc fade meter at 63° C. for 40 hours.

4. The meta-type wholly aromatic polyamide fiber according to claim 1, having:

a residual solvent content of 0.1 mass % or less in the form of a fiber before dyeing; and a strength retention of 65% or more in the form of a dyed fiber after immersion in a 20 mass % aqueous sulfuric acid solution at 50° C. for 150 hours.

5. The meta-type wholly aromatic polyamide fiber according to claim 1, wherein the UV absorber is contained in an amount of 3.0 parts by mass or more and 6.5 parts by mass or less based on the total mass of the fiber.

6. The meta-wholly aromatic polyamide fiber according to claim 1, wherein the UV absorber is at least one member selected from the group consisting of salicylic acid UV absorbers, benzophenone UV absorbers, and benzotriazole UV absorbers.

7. The meta-type wholly aromatic polyamide fiber according to claim 2, having a strength retention of 80% or more after irradiation in a xenon arc fade meter at 63° C. for 40 hours.

8. A meta-type wholly aromatic polyamide fiber comprising a UV absorber with a water solubility of less than 0.04 mg/L, and having:

a degree of dye exhaustion of 90% or more in the form of a dyed fiber; and a light resistance retention of 80% or more after carrier dyeing;

wherein an alkylbenzene sulfonic acid onium salt is not present in the meta-type wholly aromatic polyamide fiber.

* * * * *